US009671197B2

(12) United States Patent
Levilly

(10) Patent No.: US 9,671,197 B2
(45) Date of Patent: Jun. 6, 2017

(54) REMOTELY OPERATED TARGET-PROCESSING SYSTEM

(71) Applicant: Philippe Levilly, Vaudry (FR)

(72) Inventor: Philippe Levilly, Vaudry (FR)

( * ) Notice: Subject to any disclaimer, the term of this patent is extended or adjusted under 35 U.S.C. 154(b) by 65 days.

(21) Appl. No.: 14/417,712

(22) PCT Filed: Mar. 28, 2013

(86) PCT No.: PCT/FR2013/050668
§ 371 (c)(1),
(2) Date: Jan. 27, 2015

(87) PCT Pub. No.: WO2013/153306
PCT Pub. Date: Oct. 17, 2013

(65) Prior Publication Data

US 2015/0247704 A1 Sep. 3, 2015

(30) Foreign Application Priority Data

Apr. 12, 2012 (FR) ..... 12 53382

(51) Int. Cl.

| | |
|---|---|
| ***G06F 19/00*** | (2011.01) |
| ***F41G 5/06*** | (2006.01) |
| ***F41G 3/14*** | (2006.01) |
| ***F41G 3/16*** | (2006.01) |
| ***F41G 3/32*** | (2006.01) |
| ***F41G 5/26*** | (2006.01) |
| *F41H 7/00* | (2006.01) |

(52) U.S. Cl.
CPC ..... *F41G 5/06* (2013.01); *F41G 3/142* (2013.01); *F41G 3/165* (2013.01); *F41G 3/323* (2013.01); *F41G 5/26* (2013.01); *F41H 7/005* (2013.01)

(58) Field of Classification Search
CPC . F41G 5/06; F41G 3/142; F41G 3/165; F41G 3/323; F41G 5/26
USPC ..... 700/245
See application file for complete search history.

(56) References Cited

U.S. PATENT DOCUMENTS

| | | | | |
|---|---|---|---|---|
| 6,237,462 | B1 * | 5/2001 | Hawkes | F41A 23/12 89/37.05 |
| 6,813,025 | B2 * | 11/2004 | Edwards | F41G 1/38 356/422 |
| 6,973,865 | B1 | 12/2005 | Duselis et al. | |
| 2004/0020099 | A1 * | 2/2004 | Osborn, II | F41G 1/473 42/122 |

(Continued)

FOREIGN PATENT DOCUMENTS

| | | | |
|---|---|---|---|
| EP | 2333479 | A2 | 6/2011 |
| JP | 2003148897 | A | 5/2003 |

(Continued)

*Primary Examiner* — Ian Jen
(74) *Attorney, Agent, or Firm* — Faegre Baker Daniels LLP

(57) ABSTRACT

A remotely operated target-processing system includes a shooting robot having a stand supporting a firing part having an optoelectronic aiming device providing an image of the target, sensors detecting the relative position of the firing part, and actuators positioning the firing-pt. A central unit receives the instructions and the signals from the sensors and generates control signals for the actuators and the firing-pert. A control screen displays the image and embeds aiming data, and a control member directs the trajectory line.

7 Claims, 4 Drawing Sheets

(56) References Cited

U.S. PATENT DOCUMENTS

2004/0050240 A1* 3/2004 Greene ..... F41G 3/06
89/41.06
2005/0021282 A1* 1/2005 Sammut ..... F41G 1/38
702/150
2005/0229468 A1* 10/2005 Zaderey ..... F41G 1/38
42/122
2007/0137088 A1* 6/2007 Peters ..... F41G 1/473
42/111
2009/0040308 A1* 2/2009 Temovskiy ..... F41G 3/16
348/158
2009/0081619 A1* 3/2009 Miasnik ..... F41A 33/02
434/21
2009/0086015 A1* 4/2009 Larsen ..... F41G 3/165
348/46
2009/0164045 A1 6/2009 Deguire et al.
2011/0120438 A1* 5/2011 Samuels ..... F41G 1/467
124/87
2011/0132983 A1* 6/2011 Sammut ..... F41G 1/38
235/404
2011/0315767 A1* 12/2011 Lowrance ..... F41G 3/02
235/404
2013/0109451 A1* 5/2013 Hamano ..... A63F 13/837
463/5
2014/0316616 A1* 10/2014 Kugelmass ..... G05D 1/101
701/8

FOREIGN PATENT DOCUMENTS

WO WO02/03342 A1 4/2002
WO WO2004048879 A2 6/2004

* cited by examiner

REMOTELY OPERATED TARGET-PROCESSING SYSTEM

CROSS-REFERENCE TO RELATED APPLICATIONS

This application is a U.S. National Phase Patent Application based on International Application No. PCT/FR2013/050668 filed Mar. 28, 2013, which claims priority to French Patent Application No. 1253382 filed Apr. 12, 2012, the entire disclosures of which are hereby explicitly incorporated by reference herein.

BACKGROUND OF THE INVENTION

1. Field of the Invention

The invention relates to a remotely operated target-processing system.

2. Description of the Related Art

In general, a number of systems exist that track targets and neutralise them. These aiming and shooting systems are very complex for the most part and the outcome from them when these systems are implemented is often more to do with the number of missiles fired than with the precision with which the target is located.

These systems usually depend on locating the geographical position of the target, the co-ordinates of which are fed into a tracking system guiding the weapon towards the target or near to it.

SUMMARY OF THE INVENTION

The aim of the present invention is to develop a target-processing system that is particularly simple and flexible to implement and, more particularly, effective in reducing the number of shots required to neutralise a target, wherein the said system is less complex to realise and, as a result, the costs of acquisition and maintenance are reduced.

The aim of the present invention is to develop a target-processing system that will provide a precise forecast of the impact point of the projectiles in order to increase the probability of hitting the target.

In order to achieve this, the invention aims to provide a remotely operated target-processing system characterised in that it comprises:

a shooting robot that can be multi-axis with:

A. a stand supporting a firing part having:

an optoelectronic aiming device providing an image of the target, sensors that detect the relative position of the firing part, and actuators that position the firing part.

B. a central unit that receives the instructions and signals from the sensors and that generates command signals for the actuators and the firing part, C. a control screen that displays the image of the target provided by the optoelectronic device and embeds aiming data in the image (virtual reticle), and a control member (keyboard/control lever) to direct the trajectory line of the firing part and to command the settings of the firing part as well as its firing.

This target-processing system has the advantage of being very simple to put into practice since it comprises a shooting robot positioned in the intervention zone and a remote central unit, installed in a protected location, as well as a control screen and a control unit that can be installed together under a portable module communicating by radio transmission with the central unit, while the central unit itself is communicating with the shooting robot via a radio link or even via a wire connection.

These radio communications are encrypted to avoid external intrusion during a communication.

The shooting robot is installed either in a fixed location on a stand, also fixed in position, or on a mobile vehicle to deploy into an operation zone. This shooting robot has a self-protection feature and has means enabling it to self-destruct at a command from the central unit, such as during a withdrawal.

According to a particularly advantageous feature, the central unit has a gap correction function consisting of:

capturing, as the optoelectronic aiming is operating, the image of a target surface and digitising this image and the aiming point, instructing a shooting robot to shoot at the target and to capture the image of the same target surface (which has not moved) and to digitise this image with the new position of the aiming point, the "robot-weapon—optoelectronic device" aiming group having moved off its aim due to the recoil from firing, comparing the images to determine the gap between the aiming point after firing and the aiming point before firing, generating correcting signals to instruct the firing part to move in order to make the new aiming point coincide with the initial aiming point before firing.

This gap correction function provides the ability to fire multiple times at the same fixed target with remarkable accuracy since the loss of aim is corrected in real time. This gap correction function can also be used for registration firing/zeroing.

This gap correction function can be deactivated.

Thus, according to another feature of the invention, the central unit has an automatic harmonisation function to harmonise the firing part with the target in order to bring the line of sight and the mean trajectory line into convergence on the target, consisting of:

defining a surface on the target and aiming at a point in the centre of this surface, digitising the image comprising the target with the position of the aiming point, firing a series of three shots, capturing the image of the target with the impact of the three shots and digitising this image, calculating the position of the "mean" point of the impact of the three shots determining the gap between the position of the "mean" point and the position of the aiming point, moving the aiming point so that it coincides with the position of the mean point of the grouping.

This automatic harmonisation function is applied in a particularly useful and effective manner with a remarkable increase in accuracy if, at the same time and in the background, the central unit applies the gap correction function after each shot.

This automatic harmonisation function can be deactivated.

According to another advantageous feature, the central unit has a target lock-on function consisting of:

aiming at a moving target, capturing, by using the image digitised by the optoelectronic aiming device, an elementary pixelated surface on the moving target to highlight the optical features of this elementary surface that form a characteristic reference feature of the target, wherein this elementary surface forming a characteristic reference feature of the target is a block of pixels, determining the centre of this block of pixels and considering the coordinates of the centre of the block of pixels as being the coordinates of the axis of the reticle of the optoelectronic aiming device, directing the firing part and its optoelectronic aiming device on to the target by capturing successive images of the environment of the target to locate the characteristic elementary surface in each image, initiating firing in the conditions determined for the target located in this way.

This target lock-on function can be deactivated.

According to another advantageous feature, the shooting robot is equipped with a self-destruction device consisting of one or a multiplicity of charges installed at critical points in the shooting robot permitting destruction of them.

In general, the remotely-controlled target processing system is characterised by remarkably accurate shooting, economy in projectiles and less wear of the firing part. The firing part can be any type of firing part, installed on the robot and whose optoelectronic device is compatible with the functions incorporated in the central unit.

According to another advantageous feature, the shooting robot is equipped with electronic modules integrating computer interfaces compatible with military vetronics and capable of being developed further.

In the event that the firing part is replaced, it is set by applying, in particular, the harmonisation function.

According to another advantageous feature, the shooting robot uses interfaces for settings retained in memory which makes the replacement of the weapon easier.

Finally, the digital target lock-on function allows a target to be followed under difficult conditions, such as in darkness or at a distance, in order to neutralise the target at an opportune moment.

The digital target lock-on function also makes the job of the operator easier since he can track the target in automatic mode without having to concentrate over a long period on the screen, waiting for the order to fire (lessening eye strain and stress).

Actions of this type are facilitated in particular by a multi-axis robot with articulated alms, offering a great number of intervention possibilities in a difficult and congested environment.

Finally, the robot can be equipped with a light beam generator for spotlighting, or a pattern of light beams, for deterrence for example.

In general, the shooting robot represents a robotic sentry in effect, avoiding the need to deploy a person to carry out surveillance, all the more so in that a multiplicity of robotic sentries can be managed by one person in front of his/her control station and the screens.

BRIEF DESCRIPTION OF THE DRAWINGS

The present invention will be described below in more detail, using, as an example, a remotely operated target-processing system represented in the drawings attached, in which.

DETAILED DESCRIPTION

Figure 1:
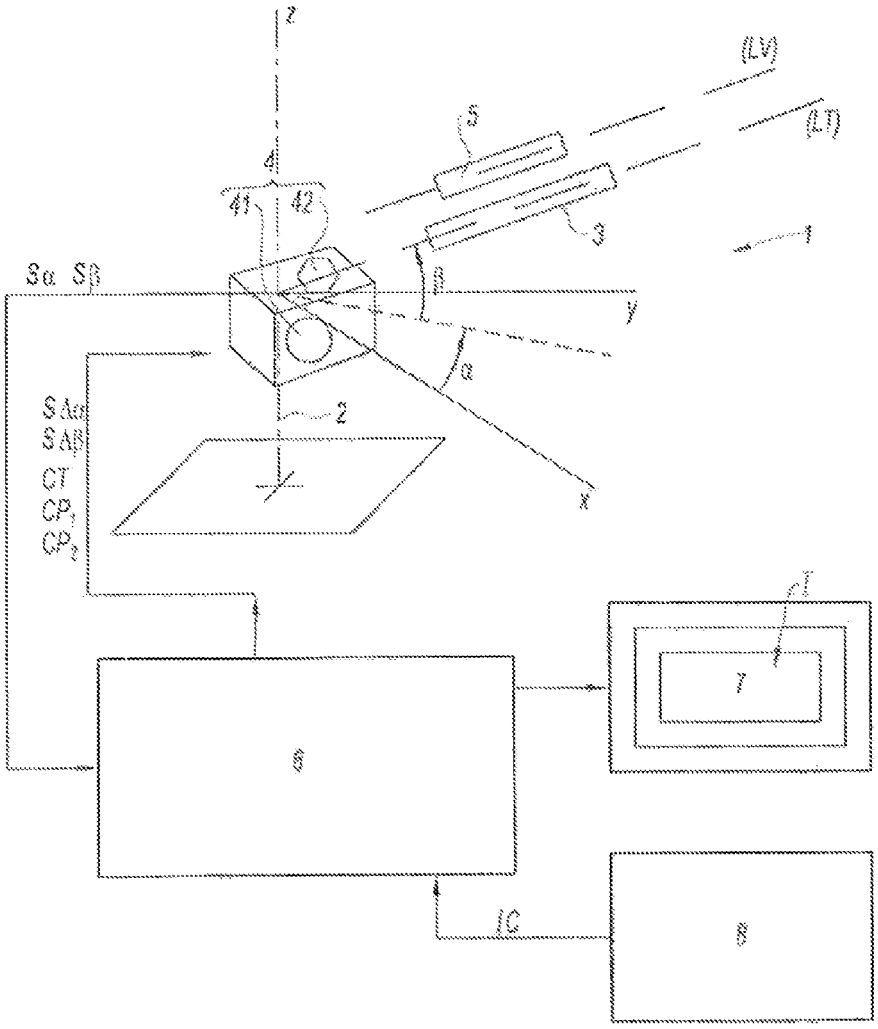
FIG. 1 is an assembly diagram of the system according to the invention.

According to FIG. 1, the aim of the invention is a remotely operated target-processing system and, to achieve this, it comprises, as shown in a very diagrammatic manner, a shooting robot 1 having a stand in the form of a foot 2, installed so that it is fixed or deployed on a vehicle and carrying a firing part 3 by means of a set 4 of positioning actuators 41, and sensors 42, very simplified, that detect the relative position of the firing part 3. The firing part 3 is linked to an optoelectronic aiming device 5 providing an image (I) of the target (not shown in this illustration).

FIG. 1 shows a reference drawn on the stand 2, for example an orthonormal set (xyz) whose origin is O, situated on the trajectory line LT of the firing part 3 and which enables the bearing ($\alpha$) and the position ($\beta$) of the trajectory line to be defined.

The optoelectronic device 5 linked to the firing part 3 has a line of sight LV. The trajectory line LT and the line of sight LV are practically parallel and meet theoretically at the target (not shown).

The shooting robot 1 is connected to a central unit 6 which itself is connected to a screen 7 and a control member 8 such as a keyboard with or without a handle or a control device of this type.

The central unit 6 also receives position signals $S\alpha$, $S\beta$ detecting the relative position of the firing part in general from the signals $S\alpha$, $S\beta$ representing the bearing a and the position $\beta$, or even more generally a variation in position relative to the references selected, such as an angular variation $\Delta\alpha$, $\Delta\beta$ relative to the position aimed at. The correction that must be made, as can be seen, is to correct the angular variations $\Delta\alpha$, $\Delta\beta$. The central unit 6 also receives instructions and commands IC to manage the actuators for the firing part 3 and its triggering by the positioning signals $S\Delta\alpha$, $S\Delta\beta$ and the firing signal CT.

The visualisation screen 7 provides the image I captured by the optoelectronic aiming device 5 incorporating the reticle and the aiming point, and combined with the information needed to process the target. The link between the shooting robot 1 and the central unit 6 is preferably a radio link, that is, not in a physical form by cable, enabling the shooting robot 1 to be controlled independent of its location, in other words, without the operator needing to be near to the shooting robot 1. The operator can be under cover in the operations zone with a portable control member 8, or at a great distance from operations at a site specially equipped with fixed installations comprising the control member 8 in this case.

The trajectory line LT is the trajectory of the projectile (line representing the centre of gravity of the projectile) leaving the firing part 3, and the line of sight LV of the optoelectronic device 5 is the direction defined by the optoelectronic reticle linked to the image captured by the optoelectronic aiming device 5. The optoelectronic reticle is a virtual image which allows the operator to take aim and which creates a physical image of the aiming point PV for the purpose of describing the functioning of the system below.

The central unit 6 has different functions for setting up the shooting robot 1. These functions are stored in the form of programmes in the central unit 6 and they are activated automatically and/or at the operator's command using the control member 8. They are managed by the control unit 6 and the operator using the screen 7 and the keyboard 8. This involves the gap correction function, the harmonisation function of the firing part 3 with its aiming system 5, and the digital target lock-on function.

Figure 2C:
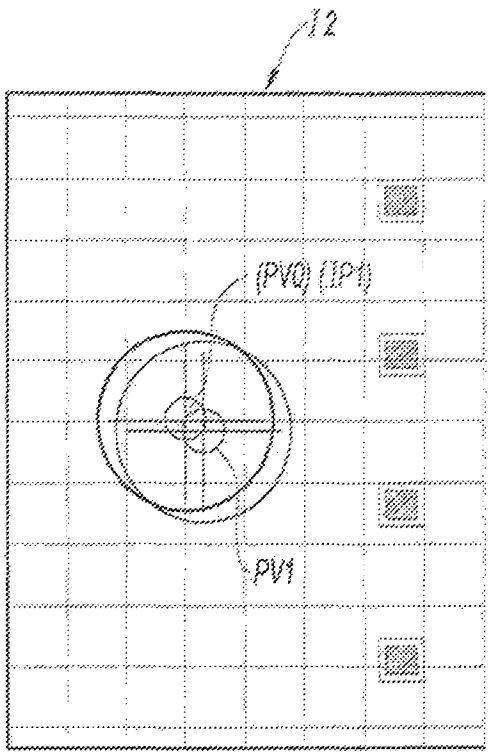
FIG. 2, parts 2A to 2C, shows different stages in applying the gap correction function according to the invention.
Figure 2B:
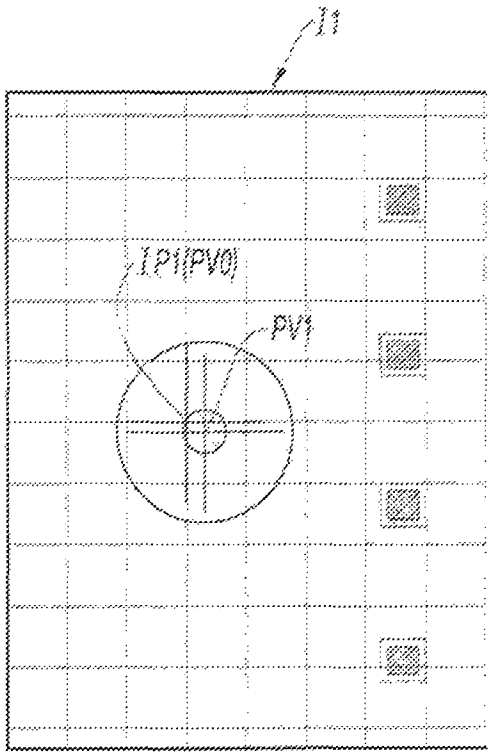
Figure 2A:
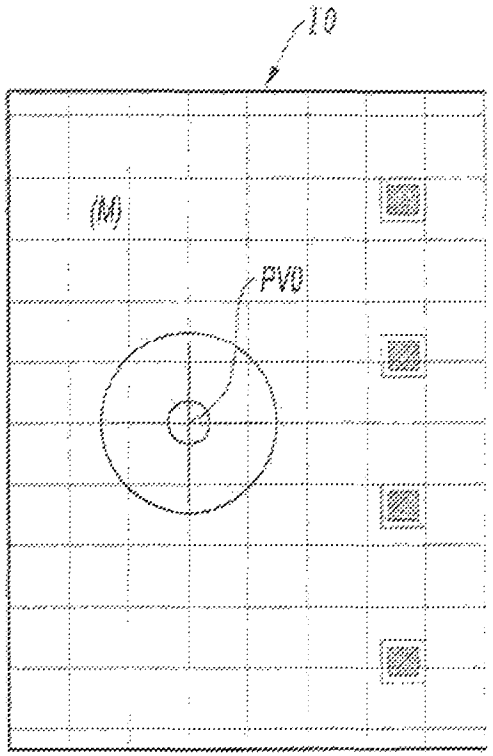

In FIGS. 2A-2C, the central unit 6 applies, according to the invention, a gap correction function FRE intended to correct the gap produced by the shooting robot 1, in this case by its firing part 3 from the recoil caused when firing. This movement causes the optoelectronic aiming device 5, which is fixed in movement with the firing part 3, to move and permits detection of the gap between the aiming point before firing PV0 and the aiming point after firing PV1 in order to reposition the line of sight LV on to the point PV0 initially aimed at.

It is assumed, before a first shot (FIG. 2A), that the weapon is adjusted perfectly, that is, that the trajectory line LT intersects the line of sight LV at the target. This situation is represented in FIG. 2A which shows a target surface on a wall M on which a point PV0 is aimed at. The image I0 provided by the optoelectronic aiming device 5 is displayed on the screen 7 (FIG. 2A). The central unit 6 records the image I0 and digitises it.

After one shot (FIG. 2B), since the recoil has moved the firing part 3, the aiming point PV1 is now offset relative to the impact IP1 produced for the projectile which is located, by definition, at the aiming point PV0. The new aiming point after firing is point PV1. The image I1 of the same surface which also surrounds target point PV1 is digitised by the central unit 6.

Then, the central unit 6 compares images I0, I1 as shown in FIGS. 2A and 2B, by image processing in order to define the coordinates of the new aiming point PV1 relative to the initial aiming point PV0. This gap corresponds to a bearing gap $\Delta\alpha$ and a location gap $\Delta\beta$.

Using the gap correction function FRE, the central unit 6 carries out the comparison of images I0, I1, applying a known method of which several versions are available commercially. Using this comparison, the central unit 6 then generates positioning signals CP1, CP2 or correcting signals $S\Delta\alpha$, $S\Delta\beta$, instructing the actuators 41 to reposition the trajectory line LT (and the line of sight LV) and lines up the centre of the reticle with the initial aiming point PV0 (FIG. 2C) which appears on the image I2.

In the illustration of the gap correction function FRE, the images I1, I2 represent the unchanged basis, that is, the surface of the target that is image I0, acting as a reference.

In FIG. 2B, the image I1 shows only the reticle and the point PV1 aimed at by the optoelectronic device 5 which was moved by the recoil from firing. This superposition of images is possible since the image I0 is stored and the reticle with its aiming point is a virtual image in the optoelectronic aiming device 5.

A similar comment can be made for the corrected image I2 in FIG. 2C which combines the basic unchanged image I0 from FIG. 2A with the image after impact IP1 of FIG. 2B as well as the reticle in the new position PV0 with impact IP1, and the position of the reticle PV1 after firing.

The gap correction function FRE for comparing images according to the invention is carried out in a very simple and very rapid manner such that the weapon is ready to take another shot. This new shot can be made at an aiming point other than the aiming point PV0 used for the first shot, the point PV0 to which the line of sight is realigned after the gap correction FRE simply being used to illustrate this adjustment function.

The rapidity with which the gap is corrected is practically instantaneous and so allows this function to be applied smoothly under normal conditions in which the shooting robot 1 is used, that is, without this gap correction slowing down the normal operation of the firing part. This gap correction function FRE can be applied automatically and systematically to realign the weapon on the aiming point PV0 after each shot on the same aiming point PV0 without intervention from the operator. This function can also be cancelled if necessary.

FIG. 3, in its parts 3A-3C, shows schematically the harmonisation function FH of the shooting robot 1 according to the invention to achieve coincidence between the line of sight LV and the trajectory line LT at the target.

In fact, due to different parameters that are often variable over time and of which it is impossible to determine the exact effect on a shot, the line of sight LV and the trajectory line LT do not coincide at a point on the target irrespective of the distance from it. The harmonisation function according to the invention consists of carrying out trial shots aiming at a surface, for example a wall M (FIG. 3A), at the appropriate distance and correcting the setting of the line of sight LV based on the grouping of the impacts on the surface aimed at (M).

Figure 3A:
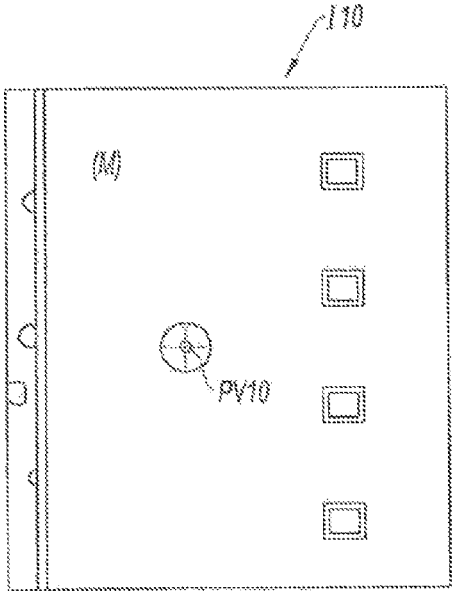
FIG. 3, parts 3A to 3C, shows different stages in applying the harmonisation function of the firing system according to the invention.
Figure 3B:
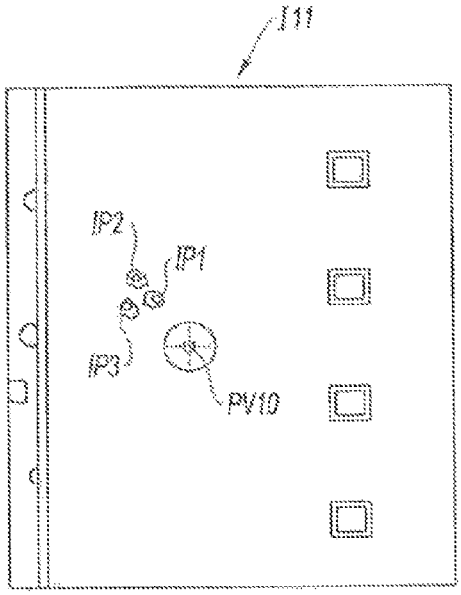
Figure 3C:
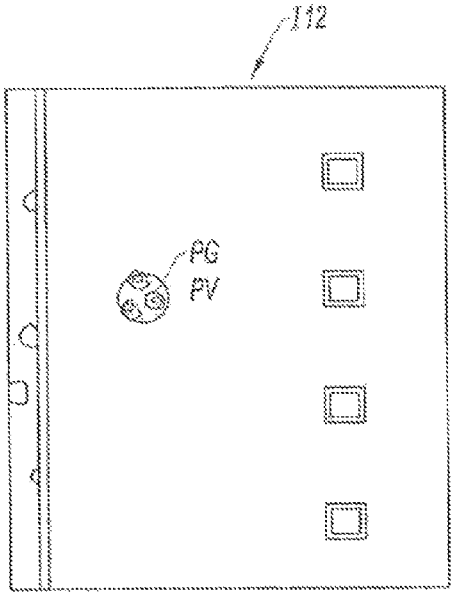

The first step in the harmonisation function FH applied by the central unit 6 consists of capturing the image I10 of the target (FIG. 3A). The image I10 is displayed on the screen 7 with the centre of the reticle which is the point PV10 aimed at by the shooting robot 1. The image I10 is stored and digitised by the central unit 6.

Next, the central unit 6 orders (CT) several shots, for example three shots (FIG. 3B), and this results in three impacts IP11, IP12, IP13, the aiming point PO being the same for the three shots.

The central unit 6 digitises the image I11 containing all of the impacts at the end of this shooting phase, together with the environment, to determine by comparing images I10, I11 the relative position of each impact IP11, IP12, IP13 relative to the aiming point PV10 which stays the same. Using calculations, the central unit 6 determines the grouping point or mean point PG, which is, for example, the centre of gravity of the impacts IP11, IP12, IP13, by its position relative to the aiming point PV10. Thus, the amount of offset of the bearing and position $\Delta\alpha$, $\Delta\beta$ between the aiming point PV10 and the mean point PG is obtained. Then the central unit 6 moves the aiming point represented by the reticle on the image of the screen 8 in the optoelectronic device 5 to the mean point PG without modifying the position of the firing part 3 and that of its optoelectronic device 5 (image I12). Harmonising the weapon consists of placing the line of sight LV of the optoelectronic device 5 on the calculated mean point PG, for example, the centre of gravity of the three impacts. One arrives at the situation represented in FIG. 3D[1]. The shooting robot 1 is thus adjusted accurately to take account, at the same time, of the parameters that are individual for, and difficult to determine for the weapon, the distance from the target and the external influences such as temperature, wind and others.

[1] Probably should be 3C. There are only 3 FIGS. 3A-3C—Translator With regard to the optoelectronic device 5, moving the aiming point consists simply of moving electronically the reticle without physically intervening in the position or fixing of the optoelectronic aiming device 5 and the firing part 3. The reticle assists in aiming as a virtual means that does not exist in the optoelectronic aiming device 5 but is incorporated in its functioning and managed by the central unit 6 to define the line of sight LV.

The harmonisation function FH according to the invention assumes that the aiming point PV10 remains the same during the operation which also implies implicitly that the gap is corrected after each shot since this gap correction function FRE, as indicated, is a transparent operation that neither hampers nor slows the normal functioning of the shooting robot 1.

The comparing of images for the gap correction function FRE and the harmonisation function FH requires an image comparison programme that is available commercially in many versions and does not warrant a detailed description.

Figure 4:
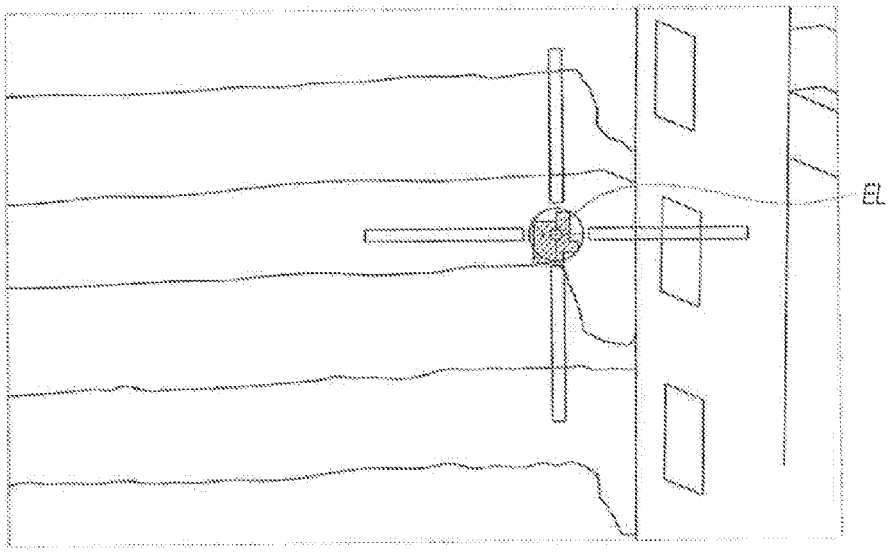
FIG. 4 shows the digitised target lock-on function.

FIG. 4 shows the target lock-on function applied by the central unit 6. In order to follow a moving target automatically, the central unit 6 orders a zone to be swept to detect the moving target or, again, can be pinpointed manually by physically positioning the line of sight on the moving target.

Next, the lock-on function consists of digitising a characteristic element of the target in the form of an elementary surface to form a characteristic reference feature (EL) defined by a small number of pixels surrounding the aiming point.

This characteristic reference feature (EL) having been defined, the central unit 6 orders the pursuit of the moving target by analysing the successive images captured with a prescribed frequency in order to determine the new position of the characteristic reference feature of the moving target by comparing one image with the succeeding image.

Then, to neutralise the moving target, a manual command transmitted from the central unit triggers the shot by the firing signal CT.

The remotely operated target-processing system described above, in particular with the help of FIG. 1, is presented in a very general manner. The foot or stand 2 that carries the firing part 3 and its optoelectronic aiming device 5 can be installed on a mobile vehicle and the stand itself can be extensible, such as telescopic, equipped with joints to follow a difficult deployment path and to position the firing part 3 in the most suitable manner. The firing part is then controlled by actuators to align its trajectory line according to its orders.

Thus, the multi-axis robot has articulated arms allowing it to process targets in inaccessible recesses and blind spots, in particular for protecting FOBs (forward operating bases). It acts as a robotic sentry.

The robot can accommodate all sorts of individual weapons firing non-lethal rounds to scale down the effects.

The robot includes a "permanent" human presence in the decision loop and, therefore, ensures the chain of command.

The parameters of the central unit can be changed (firing tables) to adjust the position of the reticle (aiming point), such as:

- the distance from the target (apogee of the projectile) with a remote interface with the central unit, most often incorporated directly in the optoelectronic aiming device,
- the characteristics of the ammunition (weight, nose shape of the projectile . . . , type of powder . . . ),
- the temperature (has a significant effect on the range of the projectile due to differences in pressure in the spherical powder),
- the speed and direction of the wind.

According to another feature, the central unit has an integral vetronic system (so that it can be interfaced with equal ease with different subassemblies such as the radio, GPS, an inertial unit, a vehicle's electrical system, cameras, sensors).

The invention claimed is:

1. A remotely operated target-processing system, comprising:

a shooting robot having a stand supporting a firing part, the shooting robot further comprising:

an optoelectronic aiming device providing an image of a target;

sensors that detect the relative position of the firing part; and actuators that position the firing part;

a central unit that receives instructions and signals from the sensors and that generates command signals for the actuators and the firing part;

a control screen that displays the image of the target provided by the optoelectronic device and embeds aiming data in the image; and a manual control member to direct the trajectory line of the firing part and to control settings of the firing part and shooting of the firing part;

wherein the central unit executes a gap correction function comprising the steps of:

capturing, as the optoelectronic aiming is operating, the image of a target surface and digitising the image and an aiming point;

instructing the shooting robot to shoot at the target and to capture the image of the same target surface and to digitise the image with the new position of the aiming point;

comparing the images to determine a gap between the aiming point after firing and the aiming point before firing; and generating correcting signals to order the movement of the firing part to make the new aiming point coincide with the initial aiming point before firing.

2. A remotely operated target-processing system, comprising:

a shooting robot having a stand supporting a firing part, the shooting robot further comprising:

an optoelectronic aiming device providing an image of a target;

sensors that detect the relative position of the firing part; and actuators that position the firing part;

a central unit that receives instructions and signals from the sensors and that generates command signals for the actuators and the firing part;

a control screen that displays the image of the target provided by the optoelectronic device and embeds aiming data in the image; and a manual control member to direct the trajectory line of the firing part and to control settings of the firing part and shooting of the firing part;

wherein the central unit executes an automatic harmonisation function to harmonise the firing part with the target in order to bring the line of sight and the mean trajectory line into convergence on the target, said function comprising the steps of:

defining a surface on the target and aiming at a point on this surface;

digitising the image comprising the target with the position of the aiming point;

firing a series of three shots;

capturing the image of the target with the impact of the three shots and digitising the image;

calculating the position of the mean point of the impact of the three shots;

determining the gap between the position of the mean point and the position of the aiming point; and moving the aiming point so that it coincides with the position of the mean point.

3. The system of claim 2, wherein during said harmonisation function, the central unit applies gap correction function to the gap produced by the firing after each harmonisation shot.

4. The system of claim 1, wherein the central unit executes a target lock-on function, comprising the steps of:

aiming at a moving target;

capturing, by using the image digitised by the optoelectronic aiming device, an elementary pixelated surface on the moving target to highlight the optical features of the elementary surface that form a characteristic reference feature of the target;

determining the centre of this block of pixels and considering the coordinates of the centre of the block of pixels as being the coordinates of the axis of the reticle of the optoelectronic aiming device;

directing the firing part and its optoelectronic aiming device on to the target by capturing successive images of the environment of the target to locate the characteristic elementary surface in each image; and initiating firing in the conditions determined for the target.

5. The system of claim 1, wherein the shooting robot is equipped with a self-destruction device comprising at least one charges installed in the shooting robot.

6. The system of claim 1, wherein said manual control member is a human-actuated control member.

7. The system of claim 1, wherein said control screen includes a visually perceptible optoelectronic reticle.

* * * * *